US008443518B2

(12) United States Patent
Fisher

(10) Patent No.: US 8,443,518 B2
(45) Date of Patent: May 21, 2013

(54) BLISTER PACKAGE OPENER

(76) Inventor: Stephen Fisher, Auburn, CA (US)

( * ) Notice: Subject to any disclaimer, the term of this patent is extended or adjusted under 35 U.S.C. 154(b) by 392 days.

(21) Appl. No.: 12/005,722

(22) Filed: Dec. 28, 2007

(65) Prior Publication Data

US 2009/0235537 A1 Sep. 24, 2009

(51) Int. Cl.
*B26B 7/00* (2006.01)
*B26B 13/06* (2006.01)
*B26B 15/00* (2006.01)

(52) U.S. Cl.
USPC ..... 30/2; 30/263; 30/264; 30/265

(58) Field of Classification Search
USPC ..... 30/DIG. 3, 2, 263–265, 278, 422, 30/424–427
See application file for complete search history.

(56) References Cited

U.S. PATENT DOCUMENTS 1,031,578 A * 7/1912 Palis ..... 30/265
1,098,671 A * 6/1914 Lundy ..... 30/265
1,422,901 A * 7/1922 Terry ..... 30/265
1,474,856 A * 11/1923 Starkl ..... 30/265
1,508,869 A * 9/1924 Astrup ..... 30/264
1,720,305 A * 7/1929 Tjernlund ..... 30/265
1,727,239 A * 9/1929 Koepp ..... 30/265
2,042,097 A * 5/1936 Havanas ..... 30/264
2,276,365 A * 3/1942 Angel ..... 30/265
2,285,249 A * 6/1942 Barentzen ..... 30/265
2,487,327 A * 11/1949 Ganter, Jr. ..... 30/264
2,527,082 A * 10/1950 Salas ..... 30/263
2,570,195 A * 10/1951 Bird et al. ..... 30/264
2,578,346 A * 12/1951 Florian et al. ..... 30/265
2,647,313 A * 8/1953 Ohlsson ..... 30/265
2,656,889 A * 10/1953 Kaplan ..... 30/DIG. 3
2,728,985 A * 1/1956 Quackenbush ..... 30/265
2,861,340 A * 11/1958 Hazzard ..... 30/264
3,075,216 A * 1/1963 Wiener ..... 30/265
3,380,158 A * 4/1968 Du Bois ..... 30/265
3,906,629 A * 9/1975 Fuchs, Jr. ..... 30/265
4,053,981 A * 10/1977 Aberer ..... 30/426
D260,358 S * 8/1981 Wilson et al. ..... D8/98
4,283,853 A * 8/1981 Fazzini ..... 30/265
4,574,480 A * 3/1986 Dunn ..... 30/265
4,646,438 A * 3/1987 Hessler ..... 30/263
4,693,004 A * 9/1987 Plana ..... 30/265
4,926,729 A * 5/1990 Igarashi ..... 83/364
D346,542 S * 5/1994 Birkholz ..... D8/98
5,692,309 A * 12/1997 Pereira ..... 30/422
5,881,624 A 3/1999 Brugue
5,899,000 A * 5/1999 Break et al. ..... 30/265
5,926,962 A * 7/1999 Chen ..... 30/519
6,298,561 B1 * 10/2001 Decker ..... 30/265
D472,786 S * 4/2003 Cech et al. ..... D8/99

(Continued)

*Primary Examiner* — Jason D Prone
(74) *Attorney, Agent, or Firm* — Heisler & Associates

(57) ABSTRACT

An opener for a blister package or for cutting of other planar material is disclosed. A cutter pair is provided adjacent an engagement area. When blister package layers are fed into the engagement area, the cutter pair including a top cutter and bottom cutter rotate to feed the package material through the engagement area. The cutters are closer together than a thickness of the package. At least one of the cutters includes a knife thereon to cause cutting of the material as it is fed between the cutter pair. A handle is provided supporting a head which has the cutter pair thereon. A motor provides power to cause rotation of the cutter pair through a gear set. A hand crank is also provided which can separately deliver power to the gear set to cause the cutters to rotate.

12 Claims, 2 Drawing Sheets

U.S. PATENT DOCUMENTS

| | | | | |
|---|---|---|---|---|
| D488,975 | S * | 4/2004 | Overthun et al. | D8/39 |
| 6,976,312 | B2 * | 12/2005 | Wiler | 30/264 |
| 7,089,669 | B2 * | 8/2006 | Fritz | 30/265 |
| 7,290,339 | B1 * | 11/2007 | Schmelzer | 30/2 |
| 7,437,825 | B2 * | 10/2008 | Sanders et al. | 30/422 |
| D584,934 | S * | 1/2009 | Feliciano | D8/99 |
| 7,591,072 | B2 * | 9/2009 | Stravitz | 30/316 |
| 7,870,675 | B1 * | 1/2011 | Della Polla | 30/2 |
| 2003/0150305 | A1 | 8/2003 | Fisher | |
| 2003/0233756 | A1 * | 12/2003 | Muhlebach | 30/265 |
| 2004/0016129 | A1 * | 1/2004 | Lammers et al. | 30/264 |
| 2007/0227319 | A1 | 10/2007 | Ross | |
| 2008/0155830 | A1 * | 7/2008 | Leifer et al. | 30/2 |
| 2009/0106985 | A1 | 4/2009 | Durham | |

* cited by examiner

BLISTER PACKAGE OPENER

FIELD OF THE INVENTION

The following invention relates to cutters and other devices for cutting of planar articles and particularly packaging, such as plastic polyethylene blister packaging. More particularly, this invention relates to cutters which are dynamic in form including moving elements to achieve cutting of the material such as packaging material.

BACKGROUND OF THE INVENTION

One form of packaging, which while convenient for display and containment of merchandise, is exceptionally difficult to open. This packaging is referred to as blister packaging or as a "blister package." With such blister packaging, two layers of plastic material (typically at least partially clear, and formed of polymeric hydrocarbon material, such as polyethylene) make up the package. These two layers are generally parallel to each other and come together at an edge where they terminate together. Heat, sonic welding, adhesive or other coupling secures the two layers together at this edge. Within limited interior portions of the blister package, the layers diverge to be spaced from each other to form a void in a shape which typically generally matches that of merchandise or other items packaged within the blister package. Typically, the two layers are only bonded together at the edge.

While some forms of bonding are relatively low strength, and can be easily opened by a user manually, most commonly these layers are exceedingly strongly secured together. While such strong securement of the layers is beneficial from a security standpoint, and to keep contents of the blister package from being damaged, lost or tampered with, such as within a store or other retail location; this strong bonding of the two layers together presents a serious challenge to one who wishes to open the blister package. For instance, after purchasing the merchandise contained within the package and taking the merchandise home, the purchaser then needs to somehow remove this secure packaging to utilize the merchandise.

Prior art systems for opening such packages are known, but have been less than satisfactory. Scissors can sometimes be utilized. However, the strength of the plastic material and its overall thickness make the user of scissors largely ineffective. When rather high strength scissors, approaching the strength of tin snips or other shears, are utilized, some effectiveness can be achieved, but the overall process is cumbersome and still requires a rather large amount of force to bring the jaws of the scissors together. When such high forces are being manually applied to the scissors, a great propensity exists to have the package open quickly and unexpectedly, and then have hands of a user move rapidly past the freshly cut edges of the packaging, creating the significant possibility of cutting hands of the user with the edges of the packaging, or the scissors. Also, such high force opening tools pose a risk of damaging the merchandise.

A razor blade can be utilized for cutting the blister package. Razor blades have a tendency to cut more than the packaging, including doing damage to an underlying surface. Also, razor blades are exceptionally sharp and pose a risk to the user and to the merchandise within the packaging. As with scissors, rather high forces are still required to utilize a razor blade to cut the layers of the blister package, again increasing the possibility that the package might open abruptly and cause the user to be cut either by a freshly cut edge of the package or by the razor blade itself.

In some instances the basic concept of scissors or a razor blade have been modified with specialty handles or other specialty housings to increase the effectiveness of a general scissors-like or razor blade-like cutter for opening of a blister package. While such attempts have generally improved upon the use of standard scissors or razor blades, the forces are still applied at a sufficiently high level and with sufficiently abrupt action, that difficulties are still encountered when utilizing such known prior art devices.

Accordingly, a need exists for a cutter suitable for cutting blister package layers for opening of a blister package which cuts through thin strong plastic or other thin materials easily and in a highly controlled fashion, for most effective opening of the blister package or cutting similar thin layered structures. Such a system could be powered or manually operated to suit the particular desires of the user.

SUMMARY OF THE INVENTION

With this invention a blister package opener is provided which avoids the relatively high exertion requirements and unpredictable operation associated with a scissors-like cutter or a razor blade. Instead, a pair of cutters are provided which are generally circular in form and which come together at an engagement area. At least one of the cutters rotates, and preferably both. This rotation causes layers of the blister package material, or other item placed within the engagement area, to be fed between the two cutters. The engagement area has a spacing between the two cutters which is less than a thickness of the layers of the blister package material or other item to be cut. Hence, the layers of material cannot merely bend and pass between the two cutters.

At least one of the pair of cutters is provided with a knife edge. Thus, the cutters rotate relative to each other and the edge of the blister package material is brought into the engagement area between the two cutter pairs, the cutters both draw the material into the engagement area and the knife on at least one of the cutters cuts the blister package material. Because the cutters act in a rotating fashion, advancement of the blister package material into the engagement area and through the cutters does not occur any faster than a rate associated with a speed of rotation of the cutters, and thus occurs in a highly controlled fashion.

Most preferably, both of the cutters rotate, and rotate together in opposite directions, tending to exert a feeding action to draw the blister package material, or other material being cut, into the engagement area. Preferably, one of the cutters has the circular knife thereon with the other cutter having a circular reference surface. This reference surface is preferably flat and in a substantially common plane with a flat side of the knife edge of the other cutter. Most preferably, the reference surface and the knife edge are in a common plane so that they are just touching each other, or only very slightly spaced from each other to avoid wear of the knife edge. A width of any such gap is preferably less than that of a single layer of the blister package material or other material to be cut.

Preferably, each of the cutters is driven in a rotating fashion by an electric motor. The motor can be contained within a head coupled to a handle that can be securely gripped by a user. A trigger on the handle forms a portion of an electric circuit along with batteries to deliver electric power to the motor. The two cutters are geared together so that they rotate together. A drive shaft from the motor is coupled to a drive gear that in turn is coupled to at least one of the cutters so that the two cutters rotate together.

Most preferably, a hand crank is also supplied with a crank shaft separately coupled to either the drive gear or one of the two cutters. This hand crank can be manually gripped and rotated to cause the cutters to rotate manually. Such a manual hand crank could be provided as a replacement for the motor or for use in conjunction with the motor, such as when the batteries run low on the opener.

To use the opener, a user merely needs to feed an edge of the blister package or other objects to be cut into the engagement area between the two cutters and either press the trigger or turn the hand crank. The cutters then feed the blister package material into the engagement area and proceed to cut the blister package material, typically along a straight cut line, along an entire substantially straight path through the blister package material. This cut path is typically selected to avoid the merchandise and void area between the two layers, such as along and parallel with one substantially straight edge of the blister package material. After the cutter has exited a second edge of the blister package material, an entire edge of the blister package material has been separated and the two layers of blister package material can be easily opened to access the merchandise between the two layers.

Objects of the Invention

Accordingly, a primary object of the present invention is to provide a tool for opening a blister package.

Another object of the present invention is to provide a tool for cutting thin planar objects.

Another object of the present invention is to provide a tool which can open a blister package or other thin planar object safely and easily.

Another object of the present invention is to provide an opener for opening a package composed of two separate layers by cutting these layers simultaneously.

Another object of the present invention is to provide a cutter for cutting generally planar objects.

Another object of the present invention is to provide an opener which can be operated either manually or with the power assistance of an electric motor.

Another object of the present invention is to provide a blister package opener which is of a simple and reliable construction.

Other further objects of the present invention will become apparent from a careful reading of the included drawing figures, the claims and detailed description of the invention.

DESCRIPTION OF THE PREFERRED EMBODIMENT

Figures 1, 2:
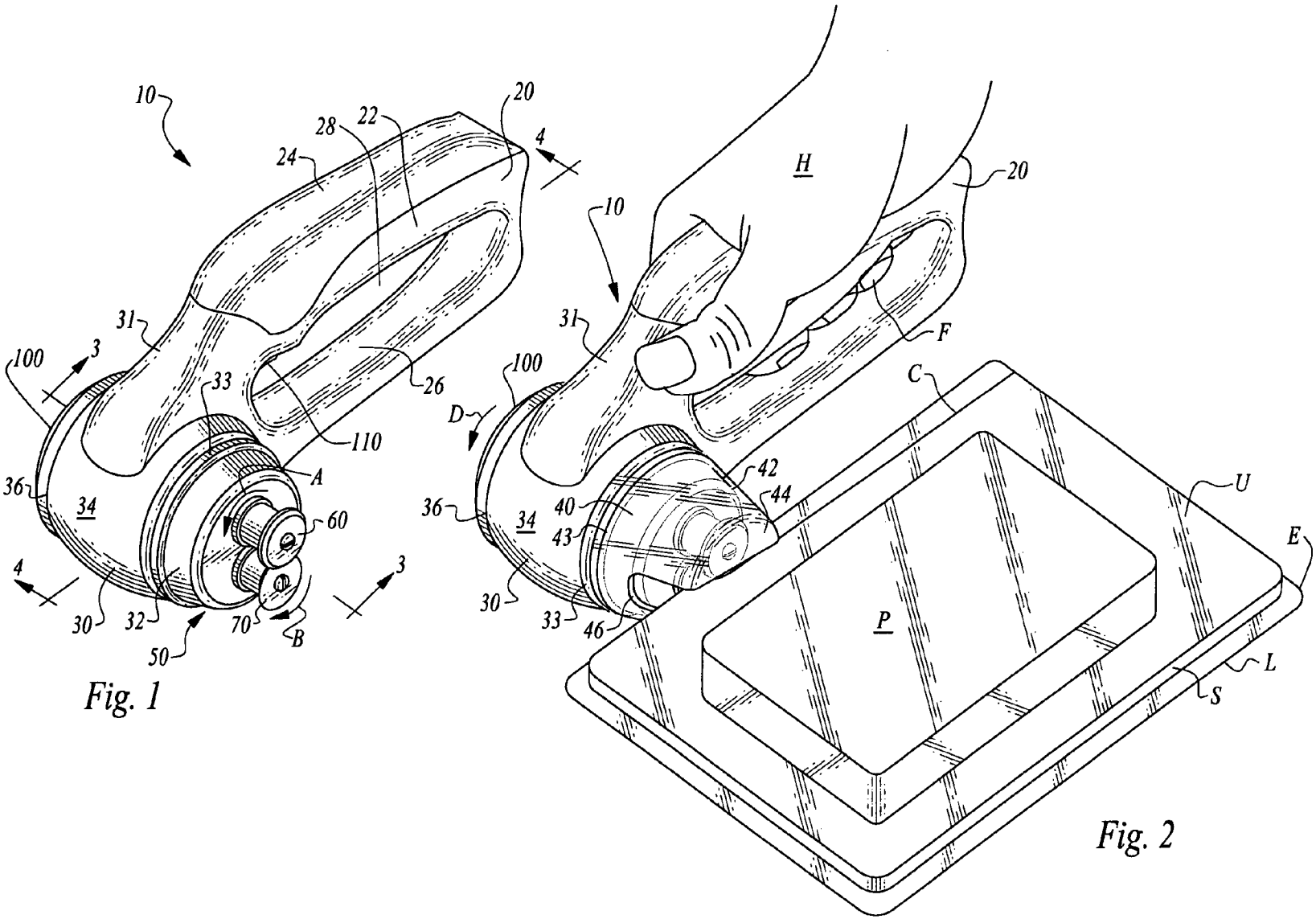
FIG. 1 is perspective view of the opener of this invention with a cover thereof removed to more clearly showed the pair of cutters for cutting open a blister package or for cutting other similar planar objects.
FIG. 2 is a perspective view similar to that which is shown in FIG. 1 but with the opener in use cutting a blister package.

Referring to the drawings, wherein like reference numerals represent like parts throughout the various drawing figures, reference numeral 10 (FIG. 2) is directed to an opener for opening a blister package P or other related package, or for otherwise cutting generally planar material. The opener 10 has a cutter pair 50 (FIG. 5) which receives an upper layer U and lower layer L of the package P within an engagement area 52 between the cutters 60, 70 (FIG. 1). The cutters 60, 70 act together to cut through an edge E of the packaging P and along a cut line C (FIG. 2). The cutting procedure occurs at a rate matching a rate of rotation of the cutters 60, 70 controlled by a motor 90 or a hand crank 100 (FIG. 3), such that relatively minimal forces are applied in a controlled fashion to open the blister package P or otherwise cut planar material.

In essence, and with particular reference to FIGS. 1 and 2, basic details of the opener 10 of this invention are generally described according to a preferred embodiment. The opener 10 is preferably formed to include a handle 20 adapted to be gripped by a hand H of a user with fingers F, and a head 30 at an end of the handle 20. A cover 40 is preferably coupled to the head 30 to protect the cutter pair 50. A slot 46 in the cover 40 precludes objects other than the blister package P from passing into the engagement area 52 of the cutter pair 50, for safe operation of the opener 10.

The cutter pair 50 includes a top cutter 60 and a bottom cutter 70. These cutters 60, 70 are preferably geared together by portions of a gear set 80 so that they rotate together and in opposite directions at a common speed. By rotating in an opposing direction, the cutters 60, 70 have a self-feeding feature tending to grip and pull the package P into the engagement area 52 to advance the opener 10 along the cut line C (FIG. 2). The gear set 80 is also preferably coupled to a motor 90. The motor 90 is coupled to a trigger 110 that can be utilized by a user to selectively operate the motor 90. Batteries 120 are supplied to power the motor 90. A hand crank 100 is also preferably supplied to give the user the option of manually turning the cutters 60, 70 for cutting of the package P or cutting of other planar materials.

More specifically, and with continuing to reference to FIGS. 1 and 2, details of the housing, including the handle 20 and head 30 are described, according to a preferred embodiment. An overall housing for the opener 10 is provided to ergonomically allow a user to hold the opener 10 and to support the cutter pair 50 and other portions of the opener 10 for powering of the cutter pair 50. This housing generally includes the handle 20 and head 30. Both the head 30 and handle 20 are preferably substantially rigid and hollow, such that they exhibit lightweight and high strength characteristics. Most preferably, the head 30 and handle 20 are formed together, such as by an injection molding procedure, such as from a polymeric hydrocarbon material, for instance polyethylene.

Figures 3, 4, 5:
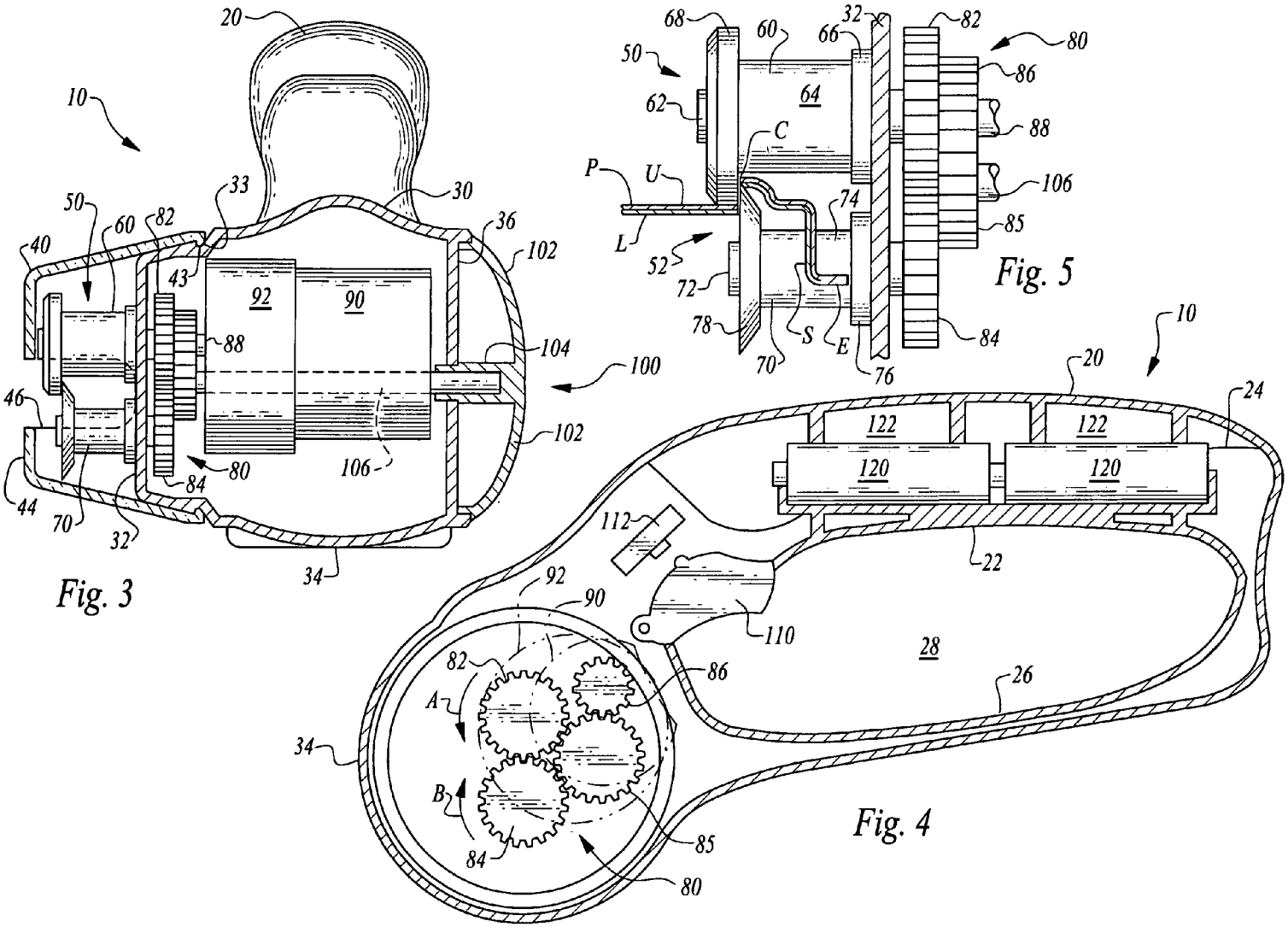
FIG. 3 is a front elevation view with a head portion thereof shown in section to reveal interior structures.
FIG. 4 is a side elevation full sectional view of that which is shown in FIG. 1.
FIG. 5 is a front elevation view of a portion of that which is shown in FIG. 3 including the pair of cutters and associated gear set, and shown in use cutting a blister package.

The handle 20 is preferably in the form of a circuit surrounding an opening 28. This circuit includes a grip arm 22 and a guard arm 26. The grip arm 22 is sized to be gripped by fingers F of a hand H of the user (FIG. 2). The opening 28 is large enough so the fingers F can pass between the grip arm 22 and guard arm 26. A cap 24 is preferably formed in the grip arm 22 which is removable. This cap 24 provides access to a compartment 122 within the grip arm 22 where batteries 120 can be housed (FIGS. 1 and 4). The guard arm 26 keeps the fingers F of the user from bumping into portions of the packaging P or other structures as the opener 10 advances along the package P, to protect from pulling the fingers F against any surfaces or other structures that might injure the fingers F of the user, or disturb progress of the opener 10.

The head 30 is located at an end of the handle 20. The head 30 joins to the handle 20 through a neck 31. The head 30 generally includes a face wall 32 which is generally planar and faces the packaging P when the opener 10 is in use. A cylindrical wall 34 extends cylindrically from the face wall 32 with the neck 31 coupled to the cylindrical wall 34. The cylindrical wall 34 is preferably somewhat barrel shaped so that it has a greater diameter at a central portion thereof than adjacent the face wall 32. An opposite wall 36 is provided opposite the face wall 32, with the opposite wall 36 also preferably being circular in form.

A groove 33 is preferably formed in the cylindrical wall 34 spaced slightly from the face wall 32. This groove 33 acts as a region in which a flange 43 of the cover 40 can snap for holding the cover 40 onto the head 30, preferably in a removable fashion. The groove 33 thus preferably circumscribes the head 30, but could be broken into segments. The head 30 is generally in the form of a hollow enclosure which contains the motor 90, gear set 80 and support for the cutter pair 50. This head 30 also preferably supports the hand crank 100.

With particular reference to FIGS. 2 and 3, details of the cover 40 are described, according to a preferred embodiment. While the cover 40 is not strictly required for operation of the opener 10, it is conveniently provided to keep the cutter pair 50 clean and free from contact with any structures other than the packaging P or other planar structures to be cut by the opener 10. For instance, the cover 40 can conveniently make sure that fingers F of the user do not pass into the engagement area 52 where they might possibility be cut by the cutter pair 50. Other objects such as hair, loose clothing, jewelry or other structures are also to some extent precluded from passing into the engagement area 52 by the cover 40. The cover 40 is thus preferably provided in a most preferred form of the opener 10 of this invention. By making the cover 40 clear, operation of the cutter pair 50 can still be closely monitored.

The cover 40 is generally in the form of a hollow frusto-conical shell with an outer wall 42 that is generally cylindrical in form but tapers slightly in a frusto-conical manner. A flange 43 is provided at an end of the outer wall 42 closest to the head 30. This flange 43 has a diameter similar to that within the groove 33 of the head 30 so that the flange 43 can snap into this groove 33 to hold the cover 40 to the head 30. An end wall 44 is provided coupled to the outer wall 42 at an end of the cover 40 opposite the flange 43. This end wall 44 is preferably substantially planar and perpendicular to a central axis of symmetry of the cover 40.

A slot 46 passes through the end wall 44 and through portions of the outer wall 42 adjacent the end wall 44. This slot 46 is preferably wide enough to allow packaging P having various different widths to easily pass into the slot 46, but while precluding objects such as fingers F from passing into the slot 46.

Blister package P typically includes a step S (FIGS. 2 and 5) slightly inboard of the edge E. This step S in some blister packages is rather short, but in other blister packages P can be quite tall. While it is desirable that the slot 46 have a width greater than that of the step S, to most easily facilitate feeding of the package P through the slot 46 and into engagement by the cutter pair 50, this step S on the package P can typically be deformed relatively easily by bending. Thus, even if the step S is taller than a width of the slot 46, the packaging P can be deformed around the step S and still fit effectively through the slot 46 and into engagement by the cutter pair 50. This slot 46 is also preferably sized smaller than a smallest human finger to preclude possible injury or at least small enough to minimize the probability of a finger accessing the engagement area 52. Even if fingers F contact the cutters 60, 70 while turning the likelihood of injury is low.

With particular reference to FIGS. 1, 3 and 5, particular details of the cutter pair 50, including the top cutter 60 and bottom cutter 70, are described according to a preferred embodiment. The cutter pair 50 defines the portion of the opener 10 which acts upon the upper layer U and lower layer L of the packaging P to cut these layers U, L or to cut similar planar objects. Other objects which could be effectively cut by the cutter pair 50 include fabrics, sheets of plastic, such as polymeric hydrocarbon materials, foil formed of metal or other materials, thin sheets of metal or other materials, and other planar objects widely ranging from foodstuffs (i.e. pastry dough) to paper products (i.e. cardboard).

The cutter pair 50 includes the top cutter 60 and bottom cutter 70. These cutters 60, 70 have an engagement area 52 therebetween. Most preferably, this engagement area 52 has portions thereof with zero width horizontally, such that the cutters 60, 70 actually touch each other. As an alternative, a very small tolerance space can be provided between the cutters 60, 70 merely to avoid damage to the cutters 60, 70 (see FIG. 5). Such a small distance, if provided, would most preferably be less than a thickness of any of the layers U, L of packaging P or other material to be cut. For instance, if the layers U, L are each one millimeter thick, the space between the cutters 60, 70 would preferably be less than one millimeter. While less desirable, the cutters 60, 70 could be spaced up to two millimeters or slightly more and still effectively cut the layers U, L with little risk of bending the layers U, L and not cutting them. These dimensions could be adjusted to accommodate layers U, L or other materials to be cut that have greater or lesser thickness. The cutters 60, 70 preferably overlap vertically a small amount, as depicted in FIG. 5.

The cutters 60, 70 rotate together, preferably at a common rate, but in opposite directions. The cutters 60, 70 are preferably both rigid structures which are generally cylindrical in form and aligned parallel with each other with the top cutter 60 located above the bottom cutter 70. In this way, a path through the engagement area 52 is generally horizontal for easy horizontal feeding of the package P through the engagement area 52 and between the cutters 60, 70. The top cutter 60 is mounted upon an axle 62 surrounded by a cylindrical body 64. Foot 66 is provided at an end of the cylindrical body 64 placed adjacent the face wall 32 of the head 30. A crown 68 is provided on the cylindrical body 64 at an end thereof opposite the foot 66. This crown 68 includes a planar reference surface against which the bottom cutter 70 acts as described below.

The bottom cutter 70 is mounted upon an axle 72 which is parallel with and spaced below the axle 62 of the top cutter 60 in a most preferred embodiment. The axles 62, 72 could be angled slightly and appropriate portions of the crown 68 and abutting portions of the bottom cutter 70 beveled with an angle similar to angles between the axles 62, 72 to maintain proper function. The bottom cutter 70 includes a cylindrical body 74 surrounding the axle 72 which is also generally preferably parallel with the cylindrical body 64 of the top cutter 60. A foot 76 defines an end of the cylindrical body 74 adjacent the face wall 32 of the head 30. A knife 78 is provided on the cylindrical body 74 on a portion thereof opposite the foot 76.

The knife 78 defines that portion of the bottom cutter 70 which cuts in conjunction with the reference surface of the crown 68 on the top cutter 60, to cut the layers U, L of the package P in the preferred embodiment of this invention. The knife 78 most preferably has a planar circular surface parallel with the circular reference surface of the crown 68 and with the planar surface of the knife 78 coplanar (or only slightly spaced by a distance defining a possible small space between the cutters 60, 70 described above) with the reference surface of the crown 68. The knife 78 tapers back from a tip at a peripheral edge of the knife 78 at a bevel angle. The tip of the knife 78 is sufficiently wide to provide the tip with sufficient mechanical strength to prevent breaking of the tip of the knife 78 under loads encountered by the cutting procedure.

As an alternative, the crown 68 of the top cutter 60 could be replaced with a knife similar to the knife 78, such that two knives would cut together with one of the knives on each of the cutters 60, 70. While the knife 78 is shown with a fairly sharp tip, and the reference surface with a blunt tip perpendicular to the reference surface, the knife 78 could be somewhat blunt tipped in form, with perhaps only a very slight angle away from perpendicular to the flat surface of the knife 78. For instance, the knife is shown with an angle of 45° from horizontal on a tapered side of the tip opposite the flat face of the knife 78. This angle could be reduced to near zero so that the believed surface would be substantially perpendicular to the flat face of the knife 78. It could also have some lesser but significant amount such as 30° away from horizontal. As another alternative, the bevel on the tip of the knife 78 could be greater than that shown, such as a 60° angle or greater, especially for versions of the opener 10 which are desired to have a greater penetrating force and where overall durability and strength of the knife 78 are less important.

Both the top cutter 60 and bottom cutter 70 preferably rotate to feed material into the engagement area 52 between the cutter 60, 70. However, it is conceivable that only one of the cutters 60, 70 would rotate. In such an embodiment, either the crown 68 or the knife 78 would be rotating and provide forces on the layers U, L of the package P tending to draw the package P into the engagement area 52. By having at least one of the cutters 60, 70 rotating, sufficient engagement and cutting force is applied to cut through the layers U, L of the package P, but with a slightly greater possibility of slippage of the cutters 60, 70 rather than gripping and continuous cutting through the layers U, L of the package P.

Cutter rotation 60, 70 is illustrated in FIGS. 1 and 4 with the top cutter 60 rotating along arrow A and the bottom cutter 70 rotating along arrow B. With arrow A rotating in a counterclockwise direction and arrow B in a clockwise direction, the cutter pair 50 draws the layers U, L of the package P into the engagement area 52 so that the opener 10 can operate in a forward direction (along the cut line C of FIG. 2).

With particular reference to FIGS. 3-5, details of the gear set 80 of the opener 10 are described according to a preferred embodiment. The gear set 80 provides a preferred form of means to transmit power to at least one of the cutters 60, 70, and preferably both, at a timed common speed and in opposite directions. This gear set 80 includes a top output gear 82 coupled to the top cutter 60 and a bottom output gear 84 coupled to the bottom cutter 70. Each of these output gears 82, 84 are in the form of spur gears on a side of the face wall 32 of the head 30 opposite the feet 66, 78 of the cutters 60, 70. These output gears 82, 84 are coplanar with each other and have their teeth meshing each other in a plane perpendicular to the axles 62, 72 of the cutters 60, 70. In this way, when one of the output gears 82 rotates, the other output gear 84 also rotates, but in an opposite direction.

A crank gear 85 is preferably coupled to one of the output gears 82, 84. For instance, one of the output gears 82, 84 can be provided thicker than the other with the crank gear 85 positioned to engage one of the output gears 82, 84 in a plane parallel to but spaced from the other output gear 84, 82, while the other output gear 84, 82 is not engaged by the crank gear 85. The other gear 84, 82 is thus driven through the output gear 82, 84 engaging the crank gear 85.

The crank gear 85 is preferably coupled to the hand crank 100 through a crank shaft 106 for direct drive of the crank gear 85 and in turn the output gears 82,84, to cause the cutters 60, 70 to rotate. In addition, drive gear 86 is preferably provided which has teeth meshed with teeth on the crank gear 85 to drive the crank gear 85. This drive gear 86 preferably is coupled to a drive shaft 88 extending from the motor 90. Thus, when the motor 90 rotates, the drive shaft 88 also rotates and the drive gear 86 in turn rotates. The drive gear 86 then causes the crank gear 85 to rotate and in turn an adjacent one of the output gears 82,84 and indirectly the other output gear 84,82, for rotation of the cutters 60,70.

This gear set 80 defines merely one variation for causing the cutters 60, 70 to rotate together and in opposite directions, with input either from the hand crank 100 or from the motor 90. Other different gear sets 80 or other transmission systems, such as sprockets and chains, belts and sheaves, liquid couplings, flexible couplings, or other power transmission elements could be interposed between the cutters 60, 70 and a means to drive the cutters 60, 70 to cause the cutters 60, 70 to rotate. In a most preferred form of this invention the means to rotate the cutters 60, 70 is either in the form of the electric motor 90 or the hand crank 100 (or both).

The motor 90 is preferably coupled to the drive shaft 88 through a transmission 92. One purpose of this transmission 92 could be to provide a different speed between the motor 90 and the cutters 60, 70. For instance, the motor 90 might typically operate at a higher speed and lower torque than desired. By including an appropriate transmission 92, a higher torque and lower speed can be provided. The transmission 92 preferably also includes some form of clutch or the motor 90 is of a type which can rotate freely and not resist rotation when the hand crank 100 is rotated manually by a user. Either the transmission 92, or motor 90 directly, avoids adding additional resistance to a user when the user wishes to utilize the hand crank 100 to cause rotation of the cutters 60, 70.

The underside of the grip arm 22, within the opening 28 of the handle 20 preferably includes the trigger 110 therein in a convenient location where an index finger of the user can toggle the trigger 110. This trigger 110 is coupled to a switch 112 (FIG. 4) for selectively operating the motor 90. For instance, a simple series circuit can be provided with the circuit including the motor 90, the batteries 120 and the switch 112. When the trigger 110 is toggled to close the switch 112, power passes from the batteries 120 to the motor 90 to cause motor 90 operation. As an alternative, the switch 112 can selectively send a signal to a processor for control and operation of the motor 90.

The switch 112 is typically of a variety which is either open or closed, but could alternatively be a speed switch which can provide a progressively higher speed or slower speed control for the motor 90 as the trigger 110 is depressed a greater or lesser amount. The batteries 120 reside within a compartment 122 within the grip arm 22 for holding the batteries 120 therein. Appropriate wiring to complete a simple series circuit or other wiring within the housing formed by the handle 20 and head 30 are omitted to more simply illustrate the other structures of this invention, but would typically form some form of complete circuit either to a common ground surface or with a full circuit of wiring.

With particular reference to FIGS. 2 and 3, particular details of the hand crank 100 are described, according to a preferred embodiment. Most preferably, the hand crank 100 provides a second auxiliary power input for the opener 10. The hand crank 100 is useful when the batteries 120 supplying power to the motor 90 have ceased to have sufficient charge to drive the motor 90 adequately. The hand crank 100 could alternatively be utilized alone, to simplify the opener 10 and eliminate the requirement of the motor 90.

The hand crank 100 extends through the head 30 and out of the head 30 at the opposite wall 36 opposite the face wall 32. Ears 102 extend from the hand crank 100 to be easily gripped by fingers or knuckles of a hand of the user. These ears 102 are coupled to a collar 104 which mounts to the crank shaft 106. The crank shaft 106 passes through the head 30 and is then coupled to the crank gear 85 of the gear set 80, as described above.

The user can utilize the hand crank 100 with a hand opposite the hand H (FIG. 2) that is gripping the grip arm 22. As an alternative, the user can swap hands and utilize a left hand to grip the grip arm 22 and utilize a right hand H to grip the hand crank 100. The user then rotates the hand crank 100 (about arrow D of FIG. 2) to cause rotation of the cutters 60, 70 and advancement through the package P. As another alternative, the user could have one hand on the package P and another hand on the hand crank 100, while the handle 20 of the opener 10 rests upon a horizontal surface. Such a utilization without gripping the grip arm 22 might be utilized initially to get the package P initially fed into the engagement area 52 and to begin the cutting process. Once the cutter pair 50 has cut past the edge E and step S, the user can most typically grip the grip arm 22 with one hand and rotate the hand crank 100 with the other hand to complete the cutting procedure for opening of the package P.

Use of the opener 10 is illustrated in FIG. 2. The cutter pair 50 is brought adjacent the edge E of the package P and the trigger 110 is pressed. The cutter pair 50 cuts into the layers U, L, and through the edge E parallel to one edge and away from the void into the packaging P. Finally, the opener reaches an exist edge at an entry point, and over the step S. The opener 10 then follows the cut line C, most preferably separating a small portion of the package P from other portions of the package P. The user can then spread the layers U, L to easily access contents within the void of the package P.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A blister package opener, comprising in combination:

a handle adapted to be gripped by a hand of a user;

a head coupled to said handle;

said head supporting a pair of cutters in fixed position relative to each other, including a first top outside cutter and a second bottom inside cutter;

said cutters each having a gear coupled thereto, and with said gear of said first cutter and said gear of said second cutter meshed together such that said cutters are adapted to rotate relative to each other;

said bottom inside cutter having a circular knife edge defining a portion thereof closest to said top outside cutter, said knife edge open to a clearance space on a side of said knife edge opposite said top outside cutter;

said clearance space having a height between said top outside cutter and said bottom inside cutter;

a wall interposed between said gears on a first side and said clearance space on a second side opposite said first side, said wall isolating said gears from said clearance space;

said clearance space having a width between said wall and said knife edge of said bottom inside cutter, said width greater than said height;

said first cutter and said second cutter having a tolerance space sized less than two millimeters therebetween;

wherein said first cutter and said second cutter are adapted to rotate in unison and in opposite directions;

said top outside cutter having a cylindrical shape with a planar reference surface closest to said circular knife edge of said bottom inside cutter;

wherein said handle has a fixed elongate form extending from said head generally along a handle longitudinal axis;

wherein said cutters are adapted to rotate about axes of rotation which are substantially perpendicular to said handle longitudinal axis;

wherein an electric motor is coupled to a source of electricity and coupled to said pair of cutters in a manner causing said first cutter and said second cutter to rotate relative to each other;

wherein a trigger is included with said handle, said trigger adapted to be manipulated by a hand of a user to selectively deliver electric power to the electric motor for selective operation of said electric motor;

wherein a hand rotatable crank is coupled to at least one of said cutters, said crank adapted to cause said cutters to rotate when said crank is rotated;

wherein said hand rotatable crank is located upon said head on a side of said head opposite said pair of cutters, said hand rotatable crank including ears coupled to a collar which mounts to a crank shaft that is coupled to at least one of said cutters, said ears extending from a side of said head opposite said cutters, said ears extending away from said head beyond all other portions of said hand rotatable crank;

wherein said handle includes a grip arm and a guard arm in fixed position relative to each other;

said grip arm and said guard arm spaced by an elongate opening;

wherein said grip arm and said guard arm are joined together at each opposite end of said elongate opening;

said head located along with said cutters adjacent to one location where said grip arm and said guard arm are joined together, and adjacent said elongate opening; and wherein said head includes a face wall on a first side of said head and an opposite wall on a second side of said head, said face wall having a planar form, said opposite wall having a planar form, said face wall oriented parallel with said opposite wall, said face wall located on a side of said head wall opposite said opposite wall, said head including a cylindrical wall extending between said face wall and said opposite wall, said cylindrical wall being barrel shaped with a greater diameter at a central portion than a diameter adjacent said face wall and said opposite wall.

2. The blister package opener of claim 1 wherein said head is joined to said handle through a neck, said neck joined to said cylindrical wall at a midpoint between said face wall and said opposite wall, said neck extending away from said cylindrical wall in a direction parallel with said face wall and said opposite wall, said handle joined to said neck on an end of said neck opposite said head.

3. The blister package opener of claim 2 wherein said opposite wall is circular in form with a raised lip extending from a perimeter of said opposite wall in a direction perpendicular to said opposite wall and away from said face wall, said opposite wall having a hole near a midpoint of said opposite wall, said hole larger than a diameter of said crank shaft.

4. The blister package opener of claim 3 wherein said collar of said hand rotatable crank has a hollow core with an end of said crankshaft located therein, said end of said crankshaft fixed to said collar, said collar passing through said hole in said opposite wall along with said crankshaft, with said collar isolating said crankshaft from edges of said hole in said opposite wall.

5. The blister package opener of claim 4 wherein said collar has a step in an outer surface thereof between a larger width portion of said collar and a smaller width portion of said collar, said smaller width portion of said collar located within said hole in said opposite wall with said smaller width portion bearing against said edges of said hole in said opposite wall, said larger width portion of said collar located on a side of said opposite wall most distant from said face wall, said step in said collar located abutting said opposite wall.

6. The blister package opener of claim 3 wherein said ears extend radially from said collar and said crankshaft out to said raised lip and into contact with said raised lip, said raised lip also being circular in form and a constant distance away from said hole in said opposite wall, said ears adapted to move relative to said raised lip when said hand rotatable crank is rotated relative to said opposite wall and said raised lip.

7. An opener for a package having two thin layers of material laying adjacent each other and defining a thickness of the package, the layers coupled together at an edge, the opener comprising in combination:

a cutter pair including a first top outside cutter and a second bottom inside cutter;

said first cutter and said second cutter each having a gear coupled thereto, and with said gear of said first cutter and said gear of said second cutter meshed together such that said cutters are adapted to rotate relative to the other;

said bottom inside cutter having a circular knife edge defining a portion thereof closest to said top outside cutter, said knife edge open to a clearance space on a side thereof opposite said top outside cutter;

said clearance space having a height between said top outside cutter and said bottom inside cutter;

a wall interposed between said gears on a first side and said clearance space on a second side opposite said first side, said wall isolating said gears from said clearance space;

said clearance space having a width between said wall and said knife edge of said bottom inside cutter, said width greater than said height;

said first cutter and said second cutter having a tolerance space sized less than two millimeters therebetween;

wherein said first cutter and said second cutter are adapted to rotate in unison and in opposite directions;

said top outside cutter having a cylindrical shape with a planar reference surface closest to said circular knife edge of said bottom inside cutter;

wherein said cutter pair is supported by a head at an end of a handle having a fixed elongate form;

said handle including a grip arm and a guard arm in fixed position relative to each other;

said grip arm and said guard arm spaced by an elongate opening;

wherein an electric motor is coupled to at least one of said first cutter and said second cutter, said electric motor adapted to cause at least one of said first cutter and said second cutter to rotate;

wherein said opener includes said handle adapted to be gripped by a hand of a user, said handle including a trigger adjacent thereto, said trigger adapted to be manipulated by a hand of a user to selectively control delivery of electric power to said electric motor;

wherein at least one of said cutters is coupled to a hand rotatable crank, said crank adapted to cause at least one of said cutters to rotate when said crank is rotated;

wherein said grip arm and said guard arm are joined together at each opposite end of said elongate opening;

wherein said handle has said fixed elongate form extending from said head generally along a handle longitudinal axis;

wherein said cutters are adapted to rotate about axes of rotation which are substantially perpendicular to said handle longitudinal axis;

wherein said hand rotatable crank is located upon said head on a side of said head opposite said pair of cutters, said hand rotatable crank including ears coupled to a collar which mounts to a crank shaft that is coupled to at least one of said cutters, said ears extending from a side of said head opposite said cutters said ears extending away from said head beyond all other portions of said hand rotatable crank;

said head located along with said cutters adjacent to one location where said grip arm and said guard arm are joined together, and adjacent said elongate opening; and wherein said head includes a face wall on a first side of said head and an opposite wall on a second side of said head, said face wall having a planar form, said opposite wall having a planar form, said face wall oriented parallel with said opposite wall, said face wall located on a side of said head wall opposite said opposite wall, said head including a cylindrical wall extending between said face wall and said opposite wall, said cylindrical wall being barrel shaped with a greater diameter at a central portion than a diameter adjacent said face wall and said opposite wall.

8. The blister package opener of claim 7 wherein said head is joined to said handle through a neck, said neck joined to said cylindrical wall at a midpoint between said face wall and said opposite wall, said neck extending away from said cylindrical wall in a direction parallel with said face wall and said opposite wall, said handle joined to said neck on an end of said neck opposite said head.

9. The blister package opener of claim 8 wherein said opposite wall is circular in form with a raised lip extending from a perimeter of said opposite wall in a direction perpendicular to said opposite wall and away from said face wall, said opposite wall having a hole near a midpoint of said opposite wall, said hole larger than a diameter of said crank shaft.

10. The blister package opener of claim 9 wherein said collar of said hand rotatable crank has a hollow core with an end of said crankshaft located therein, said end of said crankshaft fixed to said collar, said collar passing through said hole in said opposite wall along with said crankshaft, with said collar isolating said crankshaft from edges of said hole in said opposite wall.

11. The blister package opener of claim 10 wherein said collar has a step in an outer surface thereof between a larger width portion of said collar and a smaller width portion of said collar, said smaller width portion of said collar located within said hole in said opposite wall with said smaller width portion bearing against said edges of said hole in said opposite wall, said larger width portion of said collar located on a side of said opposite wall most distant from said face wall, said step in said collar located abutting said opposite wall.

12. The blister package opener of claim 9 wherein said ears extend radially from said collar and said crankshaft out to said raised lip and into contact with said raised lip, said raised lip also being circular in form and a constant distance away from said hole in said opposite wall, said ears adapted to slide relative to said raised lip when said hand rotatable crank is rotated relative to said opposite wall and said raised lip.

* * * * *